United States Patent [19]

Gwozdz

[11] 4,228,561

[45] Oct. 21, 1980

[54] SHOCK PIVOT HINGE

[75] Inventor: Joseph W. Gwozdz, Clark Summit, Pa.

[73] Assignee: McKinney Manufacturing Company, Scranton, Pa.

[21] Appl. No.: 18,509

[22] Filed: Mar. 8, 1979

[51] Int. Cl.[2] ..... E05D 7/00

[52] U.S. Cl. ..... 16/131; 16/170; 16/148

[58] Field of Search ..... 16/137, 131, 129, 148, 16/170, 130

[56] References Cited

U.S. PATENT DOCUMENTS

| | | | |
|---|---|---|---|
| 128,593 | 7/1872 | Cluff | 16/129 |
| 2,039,774 | 5/1936 | Bryson | 16/131 |
| 2,151,240 | 3/1939 | Soss | 16/148 |
| 3,561,038 | 2/1971 | Bennett | 16/128 R |
| 3,874,027 | 4/1975 | Parsons | 16/128 R |

FOREIGN PATENT DOCUMENTS

| | | | |
|---|---|---|---|
| 315743 | 11/1919 | Fed. Rep. of Germany | 16/131 |
| 828661 | 2/1938 | France | 16/137 |
| 598844 | 2/1948 | United Kingdom | 16/130 |
| 638798 | 6/1950 | United Kingdom | 16/130 |

*Primary Examiner*—Andrew V. Kundrat

*Attorney, Agent, or Firm*—Brown, Flick & Peckham

[57] ABSTRACT

A shock pivot hinge for the upper corner of a door at its hinge side includes an upper jamb leaf and a door leaf below it having an inner side for engaging the face of the door and also having an end portion provided with a vertical opening. The jamb leaf is provided with an opening directly above the door leaf opening, and a block is mounted in each opening with a pivot pin extending vertically from one of the blocks toward the other block which has a vertical passage therein receiving the pin. The pin is offset in the same direction relative to the centers of both blocks in a vertical plane perpendicular to the inner side of the door leaf, and the blocks are adapted to be turned 180° in the leaf openings to locate the pin a different distance from the inner side of the door leaf.

8 Claims, 11 Drawing Figures

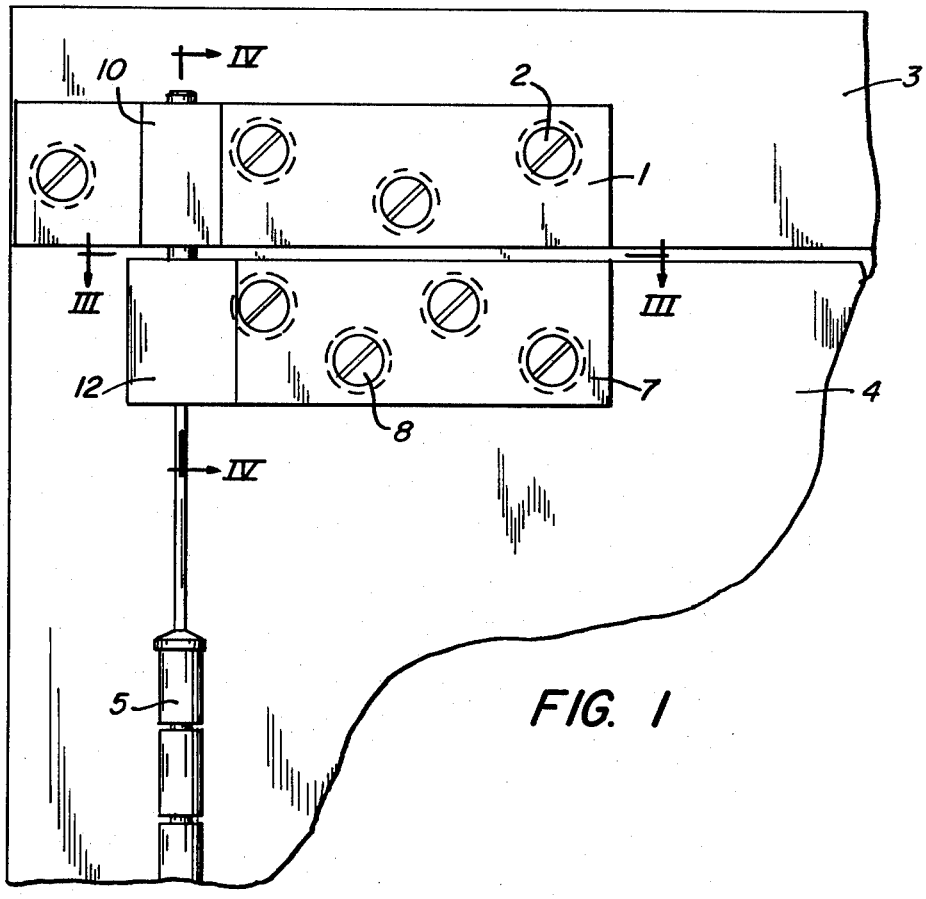
FIG. 1
FIG. 2
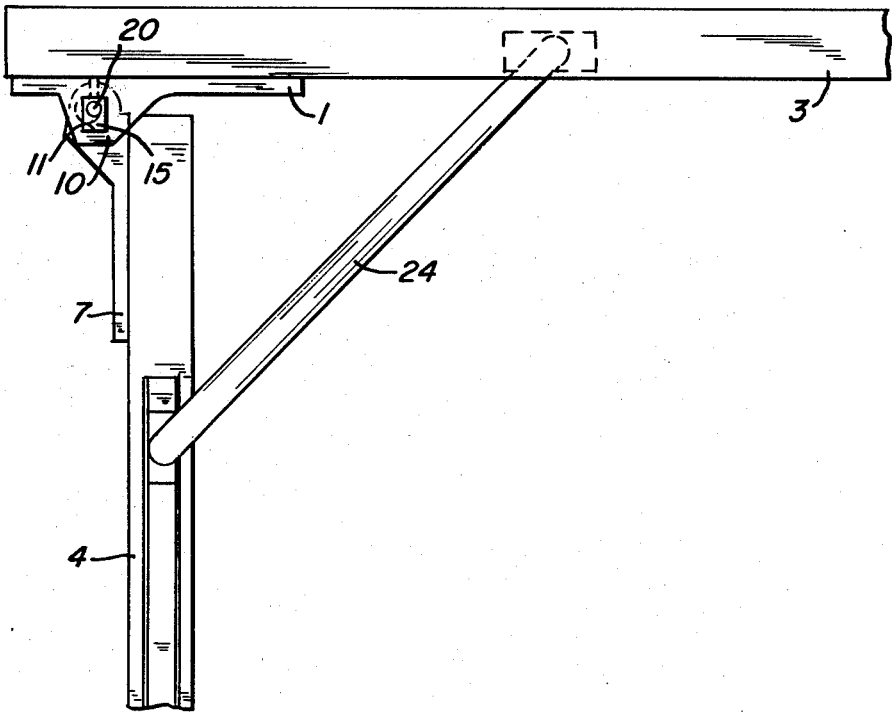

FIG. 3
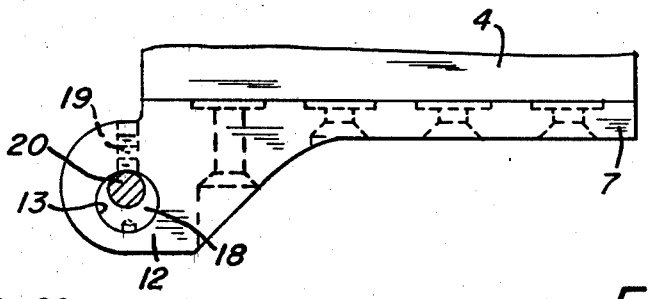
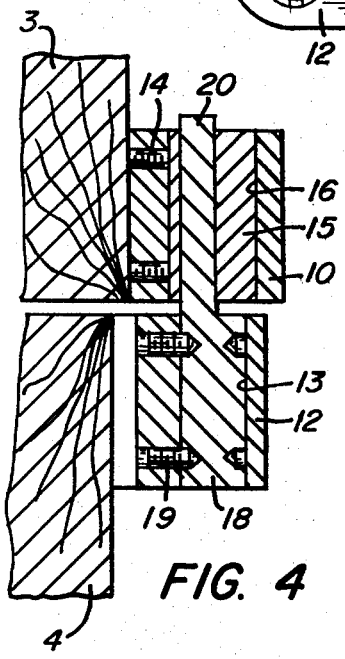
FIG. 4
FIG. 5
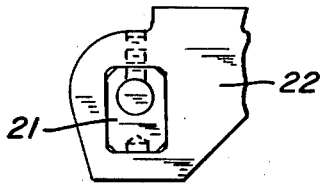
FIG. 6
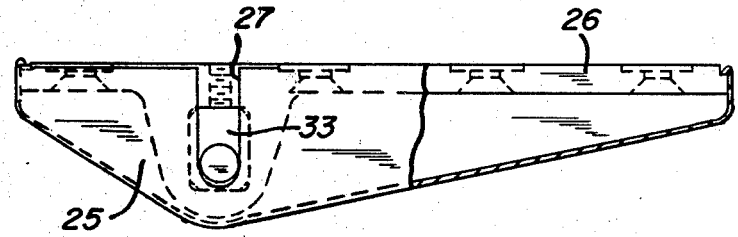
FIG. 7
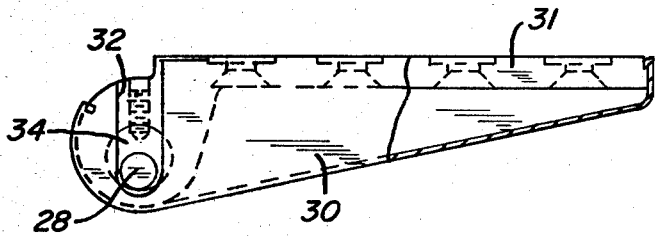

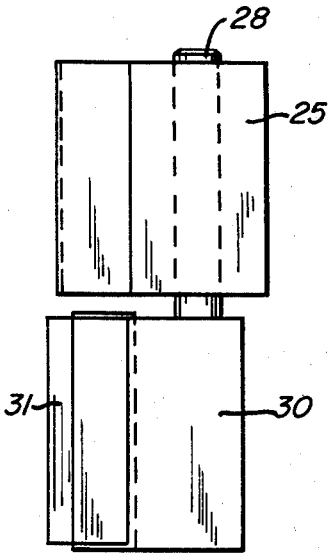
FIG. 8
FIG. 9
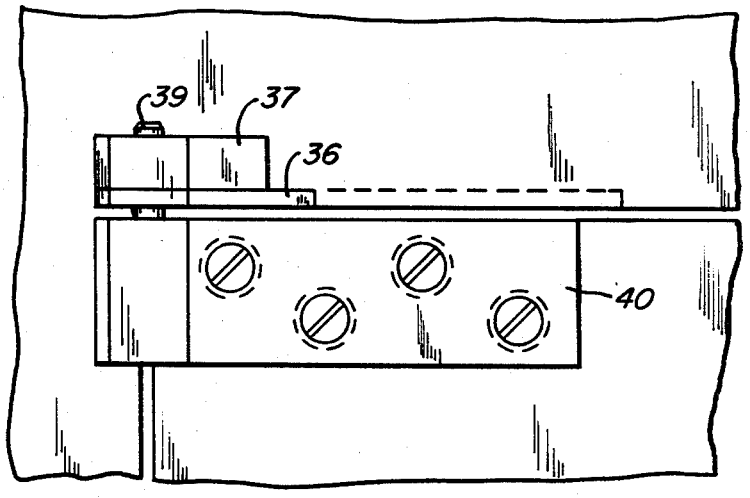
FIG. 11
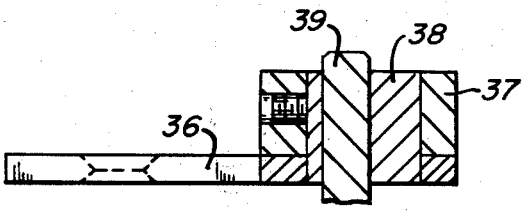
FIG. 10
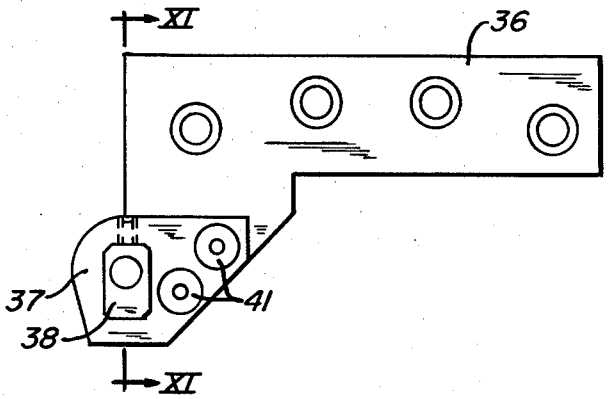

SHOCK PIVOT HINGE

When a hinged door is provided with a door stop or a door closer that limits the distance the door can be opened, there is the danger that someone may open the door with such force that when it is stopped by the door closer or door stop, the hinges may be bent or pulled from the door frame due to the tendency of the door to pivot around the end of the stop attached to the door. To prevent such loosening or damage to the hinges, an auxiliary hinge has been proposed. Such a hinge is called a shock pivot hinge or simply a shock pivot. One leaf of this hinge is secured to the face of the door at the upper corner of its hinged side, and the other leaf is secured to the jamb above the first leaf. These two leaves are hinged together by means of a pivot pin that extends vertically from one to the other. The shock pivot hinge is mounted in such position that the axis of the pivot pin is aligned with the axis of the conventional door hinge below it. When the door is opened violently, this shock pivot hinge absorbs the shock that occurs when the door is stopped by the door closer or door stop and prevents the hinges below it from being bent or pulled loose. Shock pivot hinges are shown, for example, in U.S. Pat. Nos. 3,561,038 and 3,874,027.

It is among the objects of this invention to provide a shock pivot hinge which is reversible so that it can be applied to either a right-hand or left-hand opening door, and which is adjustable in a simple manner so that the pivot pin can be located either of two different distances from the door in order to permit alignment with the hinge pins of underlying conventional hinges that project different distances from the door.

The invention is illustrated in the accompanying drawings, in which

FIG. 1 is a fragmentary elevation of a hinged door provided with my shock pivot hinge;

FIG. 2 is a fragmentary plan view;

FIG. 3 is a plan view taken on the line III—III of FIG. 1;

FIG. 4 is a vertical section taken on the line IV—IV of FIG. 1;

FIG. 5 is a fragmentary plan view of a modification;

FIGS. 6 and 7 are plan views of another embodiment of the invention;

FIG. 8 is an end view of the hinge leaves shown in FIGS. 6 and 7 when assembled;

FIG. 9 is a fragmentary elevation of another modification;

FIG. 10 is a plan view of the same modification; and

FIG. 11 is a vertical section taken on the line XI—XI of FIG. 9.

Referring to FIGS. 1 to 4 of the drawings, the main components of the shock pivot hinge are an upper plate or leaf and a door plate or leaf below it. The upper leaf has a rectangular body 1 that is fastened by screws 2 to the face of the door frame or jamb 3 above the corner of the door 4 at its hinged side, which is the side supported by two or more conventional hinges 5, the hinge pins of which project outwardly away from the door. The distance from the hinge pin axes to the door is commonly either ¾ inch or 1 inch, this being the common projection for hinges 4-½ inches and 5 inches wide, respectively, the hinge sizes most often used on doors with overhead stops.

The door leaf of the shock pivot hinge likewise has a rectangular body 7 and is secured by screws 8 to the face of the upper corner of the door directly below the upper leaf.

If the main portion of the body of the upper leaf has a uniform thickness, a portion 10 of the leaf above the hinges 5 projects outwardly over their hinge pins to provide room for a vertical opening 11 above those pins as shown in FIGS. 2 and 4. The door leaf also is provided with an outwardly projecting portion 12 directly below the projection of the jamb leaf just mentioned. This projection of the door leaf is provided with a vertical opening 13 (FIGS. 3 and 4) directly below opening 11. The upper opening preferably is rectangular in horizontal section, with its major horizontal axis lying in a vertical plane perpendicular to the innerside of the jamb leaf. Mounted in this opening 11, where it is held by set screws 14, there is a rectangular block 15 provided with a cylindrical passage 16 through it. This passage is offset relative to the center of the block in the vertical plane just mentioned.

A block 18 also is mounted in opening 13 in the door leaf and is held in place by set screws 19. Extending upwardly from this lower block is a pivot pin 20 that is offset relative to the block in the same way that passage 16 through the upper block is offset, and the pin extends up through that passage. Although lower block 18 may be rectangular like the upper one, as indicated by the block 21 in the modified door leaf hinge 22 of FIG. 5, it is preferred that it be cylindrical as shown in FIG. 3 so that the door leaf will not have to project so far from the door.

The shock pivot hinge is installed with the axis of its pivot pin 20 in alignment with the hinge pin axis of the underlying door hinge 5. Assuming that the axis of the shock pivot pin in one position is ¾ inch away from the door and in its other position is 1 inch from the door, and also assuming that the axis of the underlying door hinge pin projects ¾ inch from the door, the pivot pin and the underlying hinge pin can be aligned. On the other hand, if the underlying hinge pin axis is one inch from the door, the two blocks 15 and 18 can be turned 180° to likewise space the axis of pivot pin 20 one inch from the door. To do this with the rectangular block, it is necessary to retract set screws 14, remove the block from the jamb leaf, reverse the block by turning it 180° and replace it in opening 11. The cylindrical block 18 in the door leaf can merely be rotated 180° after set screws 19 have been retracted, without removing the block from opening 13.

By extending openings 11 and 13 entirely through the shock pivot hinge leaves, the leaves can be turned bottom side up and applied to the opposite side of the door when the door swings open to the right instead of to the left. In that case the block 18 must be removed from opening 13 in the door leaf and then reinserted in it with the pivot pin projecting from the end of the opening opposite to the end from which it projected before.

Although this shock pivot hinge has been described as having its pivot pin supported by the door leaf, it will be understood that without departing from the invention, the pin could extend downwardly from the upper leaf and into a passage in lower block 13.

If a door equipped with this shock pivot is opened rather violently and stopped suddenly by a door stop, such as shown at 24 in FIG. 2, the stresses that normally would be taken by the hinges 5 and possibly cause their deformation or loosening will be taken by the shock pivot hinge and absorbed without affecting any of the hinges.

The two leaves of the shock pivot hinge just described can be made from extruded aluminum or they can be cast from a suitable metal. Cast shock pivot hinge leaves are shown in FIGS. 6, 7 and 8 of the drawigs, which also illustrate how either of such hinges can be provided with cover plates to improve their appearance. The cover plate 25 for the jamb leaf 26 shown in FIG. 6 has a vertical front wall and parallel rearwardly extending top and bottom flanges that fit over the top and bottom of the leaf. The ends of the front wall are bent inwardly to snap into notches in the ends of the leaf. The two flanges are each provided with a slot 27 extending forwardly from the rear edge of the flange to accommodate the pivot pin 28 shown in FIGS. 7 and 8.

The cover plate 30 for the door leaf 31 shown in FIG. 7 likewise has a front wall and upper and lower flanges provided with slots 32 for pivot pin 28. The ends of the front wall are bent inwardly and snap into notches in the ends of the leaf. FIGS. 6, 7 and 8 also show the location of the pivot pin when the blocks 33 and 34 are turned 180° from the position shown in FIG. 4.

In a further modification of the invention, a jamb leaf is shown in FIGS. 9, 10 and 11 that can be used when the ones previously described cannot be secured to the face of a door frame. This modified jamb leaf has a body formed from a flat horizontal plate 36 that is mortised up into the frame above the door. At the pivot end of the leaf the plate extends outwardly past the door, and a bushing 37 is mounted on the plate and contains the reversible block 38 that receives the pivot pin 39 from the door leaf 40 below it. By fastening the bushing to the top of the plate by screws 41, the bushing can be removed and fastened to the opposite side of the plate when the plate is turned the other side up for use at the opposite side of a door.

According to the provisions of the patent statutes, I have explaied the principle of my invention and have illustrated and described what I now consider to represent its best embodiment. However, I desire to have it understood that, within the scope of the appended claims, the invention may be practiced otherwise than as specifically illustrated and described.

I claim:

1. The combination with a door supported in a door frame by conventional hinges having hinge pins spaced a predetermined distance from the door, and a stop limiting the distance the door can be opened, of a shock pivot hinge comprising an upper jamb leaf mounted on the door frame above said hinge pins, a door leaf mounted on the door between the jamb leaf and said conventional hinges, an end portion of said door leaf extending outwardly over said hinge pins and provided with a vertical opening above them, the jamb leaf being provided with an opening therein directly above said first-mentioned opening, blocks mounted in said openings, and a shock pivot pin extending vertically from one of said blocks toward the other block in axial alignment with the underlying hinge pins, said shock pivot pin being offset in the same direction relative to the centers of both blocks in a vertical plane perpendicular to the closed door, and said blocks being turnable 180° in said leaf openings to locate said shock pivot pin in axial alignment with underlying hinge pins spaced from the door a different predetermined distance than said first-mentioned predetermined distance.

2. The combination according to claim 1, in which said door leaf opening and block are cylindrical.

3. The combination according to claim 1, in which said jamb leaf opening and block are rectangular, with the major axis of the rectangle lying in said vertical plane.

4. The combination according to claim 1, in which said block-holding means are set screws.

5. The combination according to claim 1, in which each of said leaf openings extends entirely through its leaf, whereby said leaves can be used with either a right-hand or a left-hand opening door.

6. The combination according to claim 1, in which said pin is connected to the block in the door leaf, and the other block is provided with said pin-receiving passage.

7. The combination according to claim 1, in which said shock pivot jamb leaf includes a flat horizontal body plate, a bushing mounted on said end portion of the plate, and screws detachably connecting the bushing to the plate, said end portion and bushing being provided with said vertical opening extending entirely through both of them.

8. The combination according to claim 1, including a cover plate enclosing each leaf and concealing substantially all of it from view, each of said cover plates having a vertical front wall and upper and lower rearwardly extending flanges, the opposite ends of said front wall being turned inwardly into notches in the ends of the enclosed leaf.

* * * * *